US008784159B2

(12) United States Patent
Terakawa et al.

(10) Patent No.: US 8,784,159 B2
(45) Date of Patent: Jul. 22, 2014

(54) METHOD FOR POLISHING SEMICONDUCTOR WAFER

(75) Inventors: Ryoya Terakawa, Tokyo (JP); Kenji Aoki, Tokyo (JP)

(73) Assignee: Sumco Corporation, Tokyo (JP)

( * ) Notice: Subject to any disclaimer, the term of this patent is extended or adjusted under 35 U.S.C. 154(b) by 132 days.

(21) Appl. No.: 13/502,879

(22) PCT Filed: Sep. 28, 2010

(86) PCT No.: PCT/JP2010/005812
§ 371 (c)(1),
(2), (4) Date: Apr. 19, 2012

(87) PCT Pub. No.: WO2011/052132
PCT Pub. Date: May 5, 2011

(65) Prior Publication Data

US 2012/0208439 A1 Aug. 16, 2012

(30) Foreign Application Priority Data

Oct. 26, 2009 (JP) ..... 2009-245243

(51) Int. Cl.
*H01L 21/304* (2006.01)

(52) U.S. Cl.
USPC ..... 451/41; 451/287; 438/692

(58) Field of Classification Search
USPC ..... 216/88, 89; 438/692; 451/268, 269, 451/283, 287, 41, 42, 5, 57
See application file for complete search history.

(56) References Cited

U.S. PATENT DOCUMENTS

| | | | | |
|---|---|---|---|---|
| 5,234,867 | A * | 8/1993 | Schultz et al. | 438/692 |
| 5,853,604 | A * | 12/1998 | Kim | 216/88 |
| 6,114,247 | A * | 9/2000 | Nakamura et al. | 438/692 |
| 6,602,436 | B2 * | 8/2003 | Mandigo et al. | 216/88 |
| 6,790,768 | B2 * | 9/2004 | Moon et al. | 438/633 |
| 7,037,174 | B2 * | 5/2006 | Chen et al. | 451/5 |
| 8,348,720 | B1 * | 1/2013 | Ko | 451/41 |
| 2002/0019204 | A1 * | 2/2002 | Takahashi et al. | 451/286 |
| 2003/0029841 | A1 * | 2/2003 | Moon et al. | 216/89 |
| 2003/0064594 | A1 * | 4/2003 | Delage et al. | 438/691 |
| 2004/0116052 | A1 * | 6/2004 | Chen et al. | 451/57 |
| 2012/0208439 | A1 * | 8/2012 | Terakawa et al. | 451/28 |

FOREIGN PATENT DOCUMENTS

| | | |
|---|---|---|
| DE | 102 45 636 | 9/2003 |
| DE | 11 2009 002 253 | 7/2011 |
| JP | 2000-000756 | 1/2000 |
| JP | 2000-006013 | 1/2000 |
| JP | 2000-308960 | 11/2000 |

* cited by examiner

*Primary Examiner* — Lee D Wilson
*Assistant Examiner* — Tyrone V Hall, Jr.
(74) *Attorney, Agent, or Firm* — Clark & Brody

(57) ABSTRACT

In a method for polishing a semiconductor wafer by rotating a work carrier and a table while pressing the semiconductor wafer retained by the work carrier against a polishing cloth mounted on the table, at a time when the table and the work carrier both having been at rest are rotated, each at a predetermined number of revolutions, in a condition that the polishing cloth and the semiconductor wafer are pressed against each other, to thereby start polishing, a table acceleration is maintained smaller than a work carrier acceleration. By such maintaining the table acceleration smaller than the work carrier acceleration, vibrations to be generated when the polishing is started can be prevented. In the method for polishing a semiconductor wafer according to the present invention, the diameter of the semiconductor wafer is preferably defined to be 30% or more of the diameter of the table.

2 Claims, 4 Drawing Sheets

(a)

(b)

METHOD FOR POLISHING SEMICONDUCTOR WAFER

TECHNICAL FIELD

The present invention relates to a method for polishing a semiconductor wafer, and more particularly to a method for polishing a semiconductor wafer capable of reducing vibrations to be generated when polishing is started.

BACKGROUND ART

In production of semiconductor wafers, a polishing process is applied to the wafers using a polishing apparatus for the purpose of finishing a wafer surface to a mirror-smooth surface that is free of concave/convex and has a high flatness.

FIG. 1 are schematic diagrams showing a polishing process of a semiconductor wafer by means of a conventional polishing apparatus, in which FIG. 1(*a*) is a front view and FIG. 1(*b*) is a top view. The polishing apparatus shown in the said figure is composed of a work carrier 4 for retaining a wafer and a table 2 equipped with a polishing cloth 3.

In a polishing process of the wafer 5 using the polishing apparatus shown in FIG. 1, after the wafer 5 is retained by the work carrier 4, the work carrier 4 and the table 2 are rotated in the direction indicated by outlined arrows in FIG. 1(*b*) to perform polishing while pressing the wafer 5 against the polishing cloth 3 by applying load. During the polishing process, frictional forces resulting from rotation of the work carrier 4 as well as the table 2 incurred by friction between the pressed wafer 5 and the polishing cloth 3 are respectively exerted on the work carrier 4 and the table 2.

Because the frictional forces exerted on the work carrier and the table become a factor for contributing to vibrations of the work carrier, the table, or the entire apparatus, an increase in frictional force causes the vibrations to be more likely generated, and results in the generation of further intensified vibrations.

In the polishing process, the operation of starting polishing is performed, in some cases, by causing the table and work carrier both being at rest to rotate in a condition that polishing cloth and the wafer have been pressed against each other, or in other cases, after the table and the work carrier are rotated while the polishing cloth and the wafer are still apart from each other, it is performed by pressing the polishing cloth and the wafer against each other. In the latter cases, a load is immediately generated at the instant when the polishing cloth and the work carrier are pressed against each other, and the load is increased much more as a wafer diameter or a table diameter becomes greater. For this reason, in a case where the wafer is of a large diameter or where the table diameter is so large, operating while the polishing cloth and the wafer have been pressed against each other is often employed as the operation of starting polishing.

In recent years, with the increasing diameter of wafers in a polishing process, an area of contact between the wafer and the polishing cloth has been increased, while the pressing load has also been increased to secure a desired polishing rate or a surface quality. Such an increase in the area of contact and loading causes the frictional force between the polishing cloth and the wafer to be intensified. Further, when polishing is started in the condition that the polishing cloth and the wafer have been pressed against each other, the friction, which is static friction at the instance of starting polishing, causes the maximum frictional force to be generated at that instant. Therefore, in a polishing process of the large-diameter wafer, vibrations are highly likely to occur at the instance of starting polishing, while the intensity of the vibrations thus generated being vehemently high.

The vibrations generated in the polishing process of the wafer induce cracking of wafer and cause the polishing cloth to be damaged and twisted. Because the twisted polishing cloth will damage a polished surface of the wafer, thereby inducing the generation of defects, it is necessary to replace the twisted polishing cloth and product yields get worse.

To address the problem that vibrations be generated during the polishing process of the wafer, Patent Literature 1 suggests a polishing apparatus in which a piezoelectric element is installed between bearings for a rotating shaft of a work carrier and a casing for housing the bearings. In the polishing apparatus suggested in Patent Literature 1, when vibrations are generated during the polishing process, the piezoelectric element exerts a damping force to the work carrier to attenuate the vibrations, resulting in suppressing the vibrations.

In a polishing apparatus suggested in Patent Literature 2, a fluid bearing is used in place of a ball bearing as a bearing for a table rotating shaft to suppress a possibility that a table is otherwise slightly vibrated during its rotation because balls used in the ball bearing are not truly spherical due to an avoidable production error. It is understood that in this way, the formation of microscopic ripple-shaped minute concaves/convexes on the polished surface of the wafer can be avoided, leading to an improved flatness of the polished surface.

Although a certain effect of reducing the vibrations can be expected from the polishing apparatuses suggested in Patent Literatures 1 and 2, the apparatuses become complicated in structure, and accordingly problematic in terms of facility and maintenance costs. Further, in order to adapt said polishing apparatuses to existing facilities, significant modifications should be performed for the structure of the work carrier or the table. Therefore, adapting these to the existing facilities is difficult.

CITATION LIST

Patent Literature

PATENT LITERATURE 1: Japanese Patent Application Publication No. 2000-6013

PATENT LITERATURE 2: Japanese Patent Application Publication No. 2000-308960

SUMMARY OF INVENTION

Technical Problem

As described above, in a polishing process of semiconductor wafers, conventional polishing methods have encountered such a problem that when polishing is started by causing the table and the work carrier both being at rest to rotate, each at a predetermined number of revolutions, in the condition that the polishing cloth and the wafer are pressed against each other, frictional forces are exerted on the work carrier and the table due to friction between the wafer and the polishing cloth, thereby generating vibrations.

Further, in order to prevent generation of the vibrations by means of the conventional polishing apparatus, the apparatus configuration becomes complicated to develop an additional problem in terms of facility and maintenance costs. Meanwhile, the adaptation of the conventional polishing apparatus to the existing facilities, which necessitates significant modifications to the apparatus configuration, has been difficult.

The present invention, which was conceived in view of the aforesaid current problems, therefore aims to provide a semiconductor wafer polishing method capable of preventing vibrations from being generated in a polishing process when polishing is started by causing a work carrier and a table both being at rest to rotate, each at a predetermined number of revolutions, in a condition that a polishing cloth and a wafer have been pressed against each other.

Solution to Problem

As described above, the frictional forces resulting from the rotation of the work carrier and the table are respectively exerted on the work carrier and the table when polishing is started. The present inventors conceived that in association with the rotation of the table and the work carrier, the frictional forces are increased or decreased, which develops repeated cycles of a sticking state and a slipping state, resulting in generation of self-induced vibrations.

It was further considered that, in the frictional forces exerted on the work carrier and the table, the frictional force generated due to the rotation of the table and exerted on the work carrier has a greater effect on the generation of the self-induced vibrations. The frictional force exerted on the work carrier due to the rotation of the table acts in the direction indicated by a solid arrow in the above-noted FIG. 1(*b*).

The present inventors found that the frictional force exerted on the work carrier due to rotation of the table can be reduced since the friction between the polishing cloth and the wafer is shifted from static friction to dynamic friction at an early stage by rotating the table at a low rotational speed and/or rotating the work carrier at a high rotational speed at an instance of starting polishing. Based on the findings, various experiments and close study were conducted. As a result, it was discovered with respect to a table acceleration and a work carrier acceleration, which will be described below, that the generation of vibrations can be reduced by maintaining the table acceleration smaller than the work carrier acceleration.

The present invention, which was achieved based on the above-described findings, is summarized as semiconductor wafer polishing methods according to the following (1) to (3).

(1) A semiconductor wafer polishing method for polishing a semiconductor wafer by rotating a work carrier and a table while pressing the semiconductor wafer retained by the work carrier against a polishing cloth mounted on the table is characterized in that at a time when the table and the work carrier both having been at rest are rotated, each at a predetermined number of revolutions, in a condition that the polishing cloth and the semiconductor wafer are pressed against each other, to thereby start polishing, a table acceleration and a work carrier acceleration satisfy the following expression (1).

$$A<B \quad (1)$$

Where the table acceleration is defined as A ($mm/s^2$), and the work carrier acceleration is defined as B ($mm/s^2$).

(2) In the semiconductor wafer polishing method according to the above-described (1), it is preferable that the diameter of the semiconductor wafer is 30% or more of the diameter of the table.

(3) In the semiconductor wafer polishing method according to the above-described (1) or (2), it is preferable that the predetermined number of revolutions of the work carrier is equal to that of the table.

In the present invention, the "table acceleration" and the "work carrier acceleration" mean accelerations of circumferential speeds of the table and the work carrier at a point where the circumferential speed of each of the table and the work carrier reaches the maximum (hereinafter, also referred to as a "maximum circumferential speed point") within the area of a polished surface of the semiconductor wafer (hereinafter, those circumferential speeds of the table and the work carrier are also referred to as a "maximum circumferential speed of the table" and a "maximum circumferential speed of the work carrier"). The maximum circumferential speed point is indicated in FIG. 2, which will be described below.

FIG. 2 is a top view schematically showing a state in which the wafer is polished by a polishing apparatus, and also showing the point where the circumferential speed of each of the table and the work carrier reaches the maximum. In the same figure, a polishing cloth 3 mounted on a table (not shown) and a wafer 5 retained by a work carrier (not shown) are shown. As shown in the figure, the maximum circumferential speed point X is a point on the outer circumference of the wafer, and located at a maximum distance from the center of rotation of the table. In this invention, an acceleration of the circumferential speed of the table at the maximum circumferential speed point X denotes the table acceleration, while an acceleration of the circumferential speed of the work carrier at the maximum circumferential speed point X denotes the work carrier acceleration.

Advantageous Effects of Invention

In the semiconductor wafer polishing method according to the present invention, at a time when the work carrier and the table having been at rest are rotated, in a condition that the polishing cloth and the wafer are pressed against each other, at predetermined rotating speeds to thereby start polishing, the generation of vibrations can be prevented by maintaining the table acceleration smaller than the work carrier acceleration. In this way, the vibrations to be generated when polishing is started can be prevented while curbing facility and maintenance costs without modifying an apparatus configuration in existing facilities.

DESCRIPTION OF EMBODIMENTS

Figure 1:
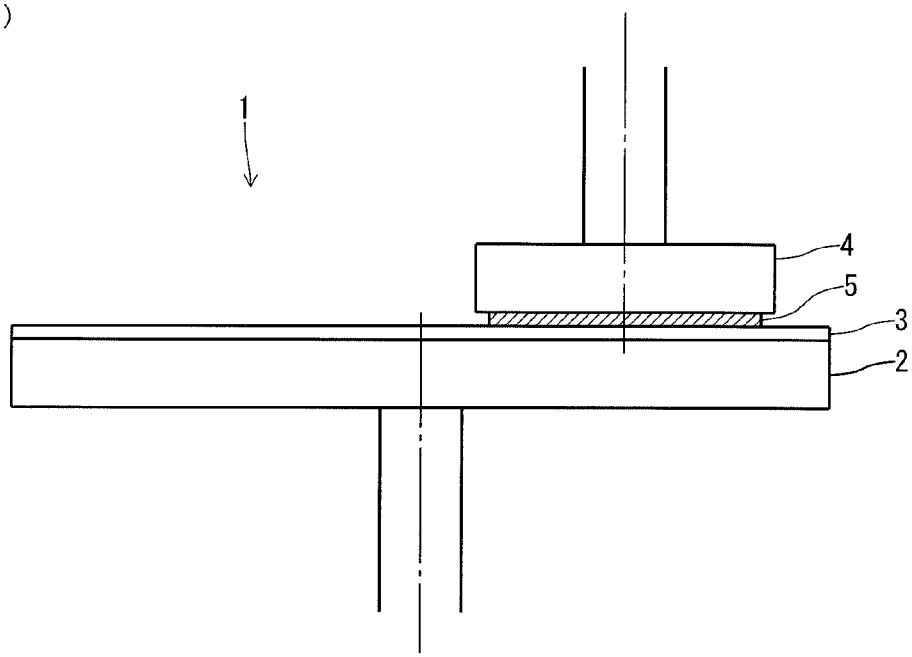
FIG. 1 are schematic diagrams showing a polishing process of a semiconductor wafer using a conventional polishing apparatus, wherein FIG. 1(*a*) is a front view, and FIG. 1(*b*) is a top view.
Figure 1:
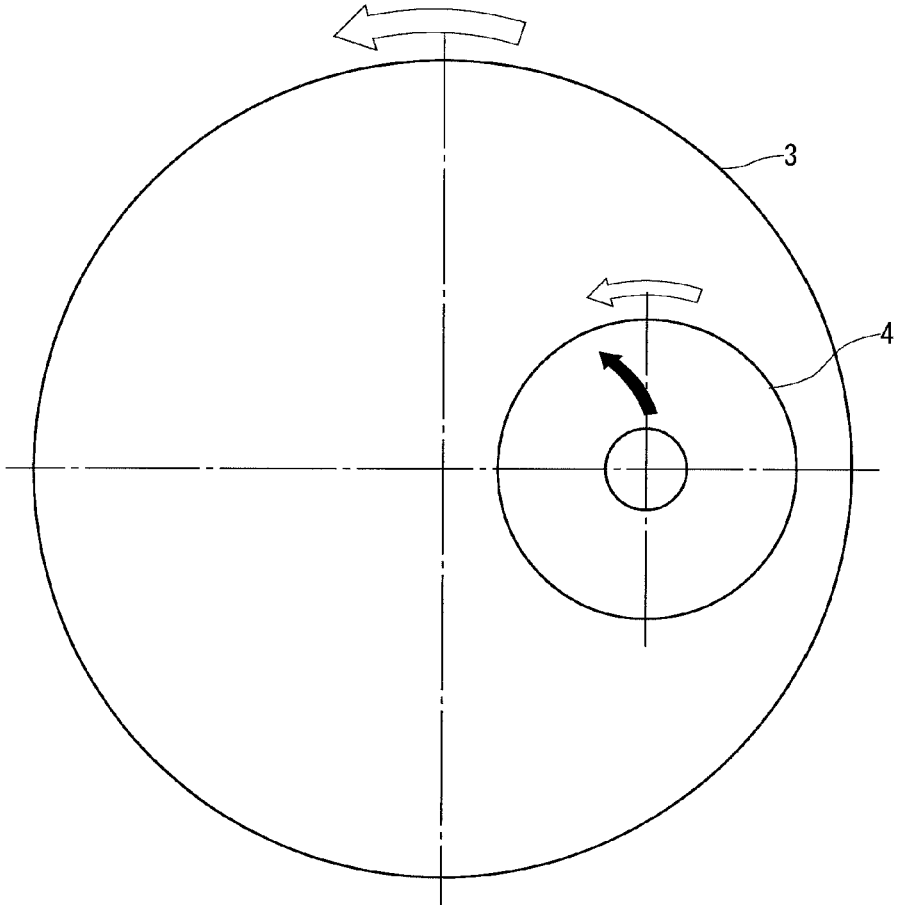
Figure 2:
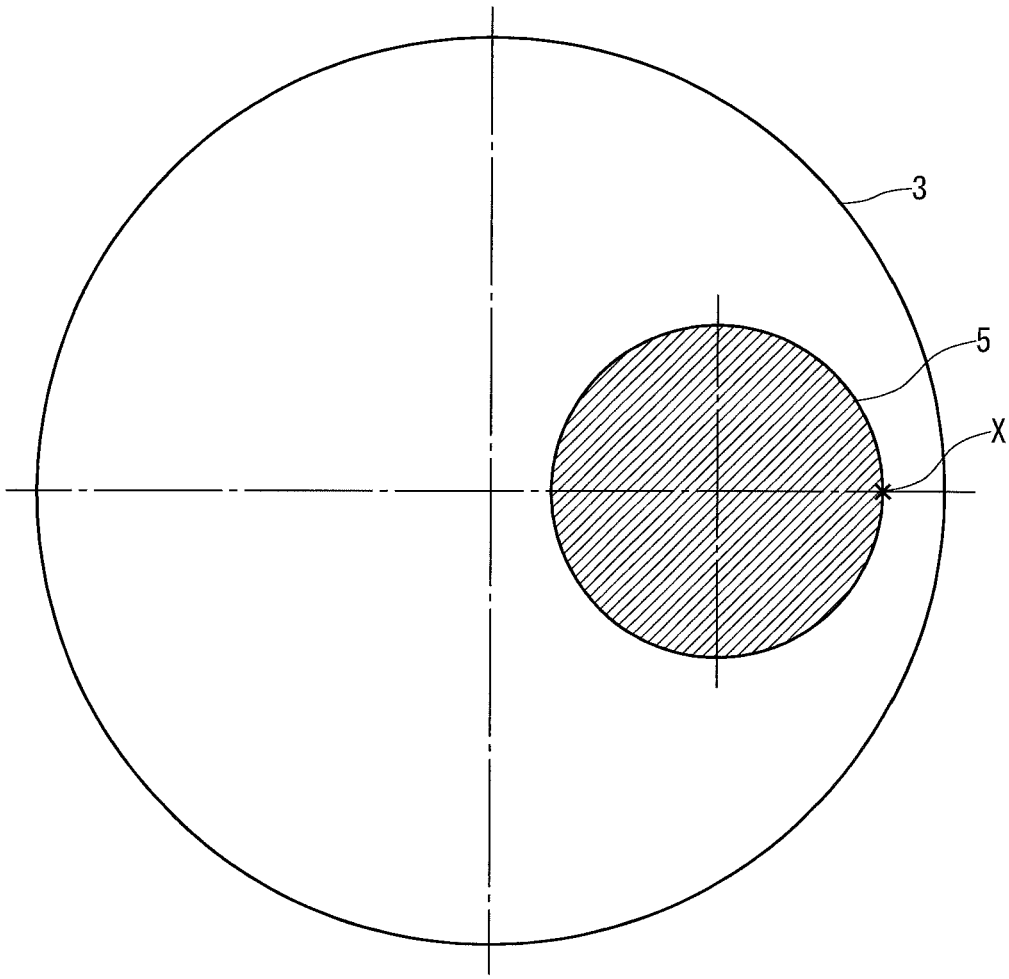
FIG. 2 is a top view schematically showing a state in which a wafer is polished by a polishing apparatus, and also showing a point where the circumferential speed of each of a table and a work carrier reaches the maximum.

Hereinafter, a method for polishing a semiconductor wafer according to the present invention will be described in detail.

A semiconductor wafer polishing method according to this invention for polishing a semiconductor wafer by rotating a work carrier and a table while pressing the semiconductor wafer retained by the work carrier against a polishing cloth mounted on the table is characterized in that at a time when the work carrier and the table both having been at rest are rotated, each at a predetermined number of revolutions, in a condition that the polishing cloth and the semiconductor wafer are pressed against each other, to thereby start polishing, a table acceleration and a work carrier acceleration satisfy the following expression (1):

$$A<B \quad (1)$$

where the table acceleration is defined as A ($mm/s^2$), and the work carrier acceleration is defined as B ($mm/s^2$).

When the table acceleration and the work carrier acceleration satisfy the expression (1), i.e. when the table acceleration is smaller than the work carrier acceleration, the static friction between the wafer and the polishing cloth is promptly shifted to dynamic friction at an early stage after starting polishing, which can lead to reduction in the frictional force to be exerted on the work carrier due to the rotation of the table. In this way, it becomes possible to reduce the self-induced vibration that is generated by repeated cycles of the sticking state and the slipping state resulting from the increase and decrease of the frictional force.

In the semiconductor wafer polishing method according to this invention, the diameter of the semiconductor wafer is preferably defined to be 30% or more of a table diameter. In a case where the diameter of the wafer is less than 30% as a percentage of the table diameter, i.e. in a case of a small-diameter wafer, the frictional force occurring between the polishing cloth and the wafer is small. Such a small frictional force does not easily bring about vibrations, and brings about only minute vibrations. In this case, even if the semiconductor wafer polishing method of this invention is applied, it is unlikely to obtain the effect of further reducing the vibrations.

On the other hand, in a case where the wafer has a large diameter, which is 30% or more of the table diameter, the frictional force occurring between the polishing cloth and the wafer is increased, thereby likely causing vibrations to be generated, and causing intensified vibrations to be generated. In this case, the effect of reducing the vibrations can be obtained by applying the semiconductor wafer polishing method of this invention.

Meanwhile, the wafer diameter is preferably defined to be less than 50% of the table diameter. When the wafer diameter is 50% or more of the table diameter, because the wafer is polished in a state where the center of the table is covered by the wafer itself, slurry suppliability is significantly reduced in the vicinity of the center of the table, which makes the polishing cloth prone to deterioration. As a result, uniform polishing of the wafer cannot be achieved.

In the semiconductor wafer polishing method of this invention, the work carrier is preferably rotated at the same number of revolutions as that of the table to polish the wafer. In this way, because equal travel distances relative to the polishing cloth can be obtained at all positions in a wafer plane, uniform polishing of the wafer can be achieved.

EXAMPLES

The following test was conducted to confirm the effect obtained by the semiconductor wafer polishing method according to this invention.

(Test Condition)

The semiconductor wafer was polished using the polishing apparatus configured as described in above-noted FIG. 1 to study generation status of vibrations. To start polishing, the work carrier and the table both having been at rest were rotated, each at a predetermined number of revolutions, in a condition that the polishing cloth and the semiconductor wafer had been pressed against each other. In operation to start polishing, the wafer was pressed against the polishing cloth by own weight of the work carrier rather than additionally applying a pressing force to the work carrier.

The test was conducted using the polishing apparatus in which a table diameter was 1200 mm and a distance between the center of rotation of the table and the center of rotation of the work carrier was 300 mm, using the wafer having a diameter of 450 mm as a test piece.

The number of revolution per minute of the work carrier and the table were set to 30 rpm, and the table was controlled to reach the defined number of revolution in 10 seconds from the beginning. For the work carrier, the time required to reach the defined number of revolution from the beginning was set to 3.1 seconds in Inventive Example 1 and 4.6 seconds in Inventive Example 2, and set to 6.6 seconds in Comparative Example 1 and 9.3 seconds in Comparative Example 2. In the test, the number of revolution of each of the work carrier and the table was recorded every 1 second for a time period of 25 seconds from the beginning of the operation to start polishing.

(Test Result)

Figure 3:
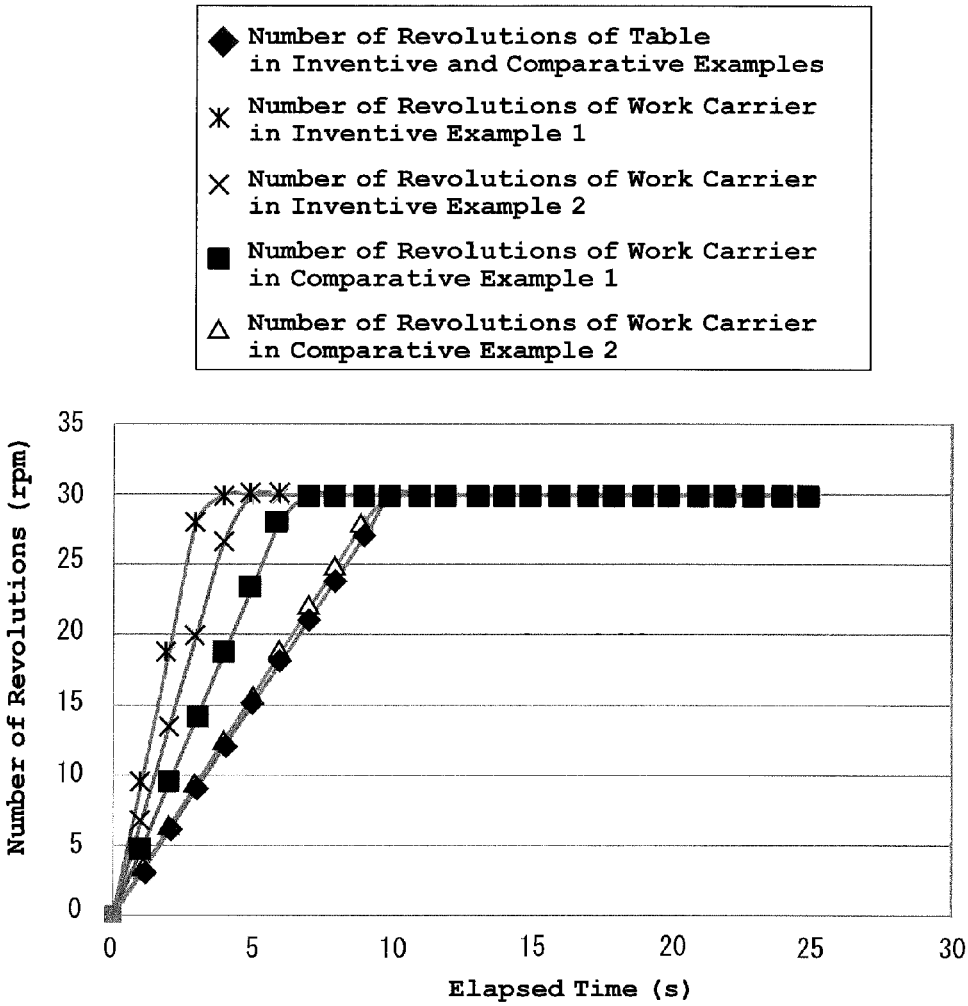
FIG. 3 is a diagram showing a relationship between elapsed time (second) and the number of revolutions (rpm) of the table and the work carrier.

FIG. 3 is a diagram showing a relationship between elapsed time (second) and the number of revolutions (rpm) of the table and the work carrier. From a graph denoted in the same figure, it has been confirmed that the table and the work carrier reached the predetermined number of revolutions upon the elapse of the predefined lengths of time both in the inventive examples and the comparative examples. The maximum circumferential speeds of the table and the work carrier at each elapsed time were calculated from the number of revolutions (rpm) shown in the same figure.

Figure 4:
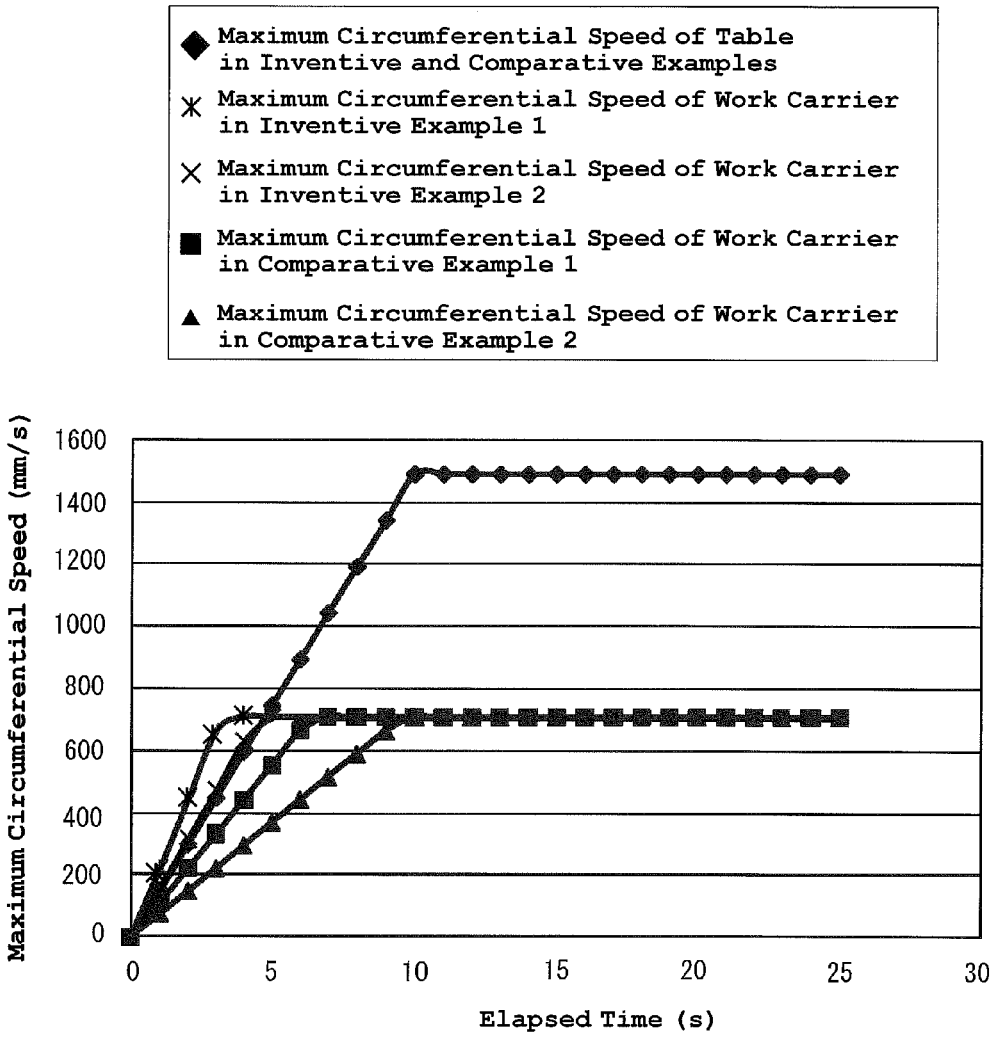
FIG. 4 is a diagram showing a relationship between elapsed time (second) and the maximum circumferential speeds (mm/s) of the table and the work carrier.

FIG. 4 is a diagram showing a relationship between the elapsed time (second) and the maximum circumferential speeds (mm/s) of the table and the work carrier. In the same figure, a slope of a graph on which the maximum circumferential speed of the table is plotted represents the table acceleration ($mm/s^2$), and slopes of graphs on which the maximum circumferential speeds of the work carrier are plotted represent the work carrier accelerations ($mm/s^2$).

In Inventive Example 1 and Inventive Example 2, the slope of the graph on which the maximum circumferential speed of the table is plotted is smaller than the slopes of the graphs on which the maximum circumferential speeds of the work carrier are plotted, i.e. the table acceleration was smaller than the work carrier accelerations, and no vibration was created both at the beginning of the operation to start polishing and at the predetermined rotating speeds.

In Comparative Example 1, the table acceleration was greater than the work carrier acceleration, and vibrations were generated at the operation to start polishing, whereas no vibration was generated at the predetermined number of revolutions. Further, in Comparative Example 2, the table acceleration was significantly greater than the work carrier acceleration, and intensified vibrations were generated at the beginning of the operation to start polishing, whereas no vibration was generated at the predetermined number of revolutions.

From the above, it was confirmed that vibrations were prevented from being generated in the polishing apparatus when the work carrier and the table were rotated in the condition that the polishing cloth was pressed against the wafer to thereby start polishing according to the semiconductor wafer polishing method of this invention.

INDUSTRIAL APPLICABILITY

According to the semiconductor wafer polishing method of this invention, vibrations to be generated in the polishing apparatus can be prevented by maintaining the table acceleration smaller than the work carrier acceleration at a time when the work carrier and the table both having been at rest are rotated, each at the predetermined number of revolutions, in the condition that the polishing cloth and the wafer are pressed against each other, to thereby start polishing. In this way, the generation of vibrations can be prevented with facility and maintenance costs being curbed without making any modification to the apparatus configuration in existing facilities.

Thus, by applying the semiconductor wafer polishing method of this invention to the production of semiconductor wafers, because the wafer can be prevented from generating cracking due to vibrations, and damage to the polishing cloth can be reduced, both improvement in product yields and enhancement in efficiency of producing the semiconductor wafers can be achieved.

REFERENCE SIGNS LIST

1: Polishing apparatus, 2: Table, 3: Polishing cloth, 4: Work carrier, 5: Semiconductor wafer, X: Maximum circumferential speed point

What is claimed is:

1. A semiconductor wafer polishing method for polishing a semiconductor wafer by rotating a work carrier and a table while pressing the semiconductor wafer retained by the work carrier against a polishing cloth mounted on the table, wherein:

at a time when the table and the work carrier both having been at rest are rotated, each at a predetermined number of revolutions, in a condition that the polishing cloth and the semiconductor wafer are pressed against each other, to thereby start polishing, a table acceleration and a work carrier acceleration satisfy following expression (1);

$$A<B \quad (1)$$

where the table acceleration is defined as A ($mm/s^2$), and the work carrier acceleration is defined as B ($mm/s^2$) and wherein the diameter of the semiconductor wafer is in a range of 30% or more to less than 50% of the diameter of the table.

2. The semiconductor wafer polishing method according to claim 1, wherein the predetermined number of revolutions of the work carrier is equal to that of the table.

* * * * *